United States Patent [19]

Znojkiewicz

[11] Patent Number: 4,535,308

[45] Date of Patent: Aug. 13, 1985

[54] MICROWAVE CAVITY TUNER

[75] Inventor: Maciej E. Znojkiewicz, Mount Royal, Canada

[73] Assignee: Northern Telecom Limited, Montreal, Canada

[21] Appl. No.: 532,388

[22] Filed: Sep. 15, 1983

[30] Foreign Application Priority Data

May 16, 1983 [CA] Canada ..... 428267

[51] Int. Cl.[3] ..... H01P 7/06

[52] U.S. Cl. ..... 333/232; 333/209; 333/235; 333/263

[58] Field of Search ..... 333/202–212, 333/222–224, 226–232, 234, 235, 245, 248, 263

[56] References Cited

U.S. PATENT DOCUMENTS 2,124,029 7/1938 Conklin et al. ..... 333/234
3,311,839 3/1967 Rutulis ..... 333/232
3,737,816 6/1973 Honicke ..... 333/209 X

*Primary Examiner*—Marvin L. Nussbaum
*Attorney, Agent, or Firm*—Thomas Adams

[57] ABSTRACT

In a microwave device, particularly a microwave local oscillator, frequency variations due to temperature changes are reduced by supporting the tuning element, for example a quartz or sapphire crystal, in the end of a tube of INVAR or other material having a low thermal coefficient of expansion. The tube projects into the cavity from a hole in one wall thereof. Preferably the tube is positively located relative to the cavity by means of an external lip on the tube abutting a shoulder formed by a reduced diameter part of the hold adjacent the cavity. The lip may be urged into positive contact with the shoulder by a spring washer acting between the end of the tube and the opposed end of a bush screwed into the hole.

5 Claims, 1 Drawing Figure

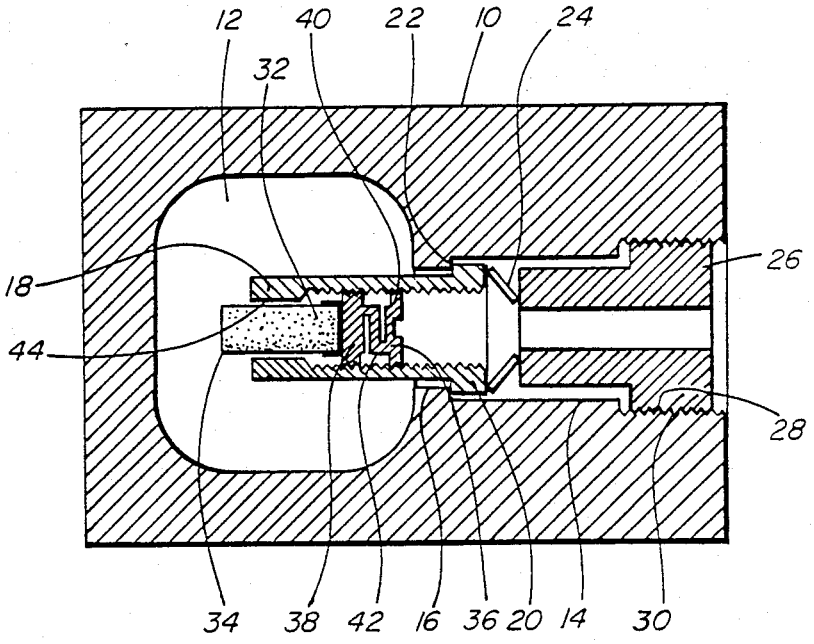
12
40
22
10
24
32
26
18
44
28
34
38
42
16
36
20
14
30

MICROWAVE CAVITY TUNER

The invention relates to microwave cavity resonators in which a tuning element protrudes into the cavity.

The invention is especially applicable to the problem of frequency stability of such resonators. Usually temperature variations cause dimensional changes which produce corresponding variations in the inductance and capacitance of the cavity. This produces a corresponding frequency change. Hitherto the problem has been addressed by using a material of low thermal expansion coefficient, such as INVAR in the tuning element to limit its length change. Consequently, as the cavity size increases the distance between the end of the tuning element and the opposite wall of the cavity increases. Accordingly the capacitance changes oppositely to the inductance and so tends to stabilize the frequency.

One tuning mechanism using this principle has an externally screwthreaded tube projecting into the cavity. Its external end is closed and an INVAR rod is slidably housed within the tube so that one of its ends abuts the closed end of the tube and its other end projects some distance beyond the end of the tube and impinges upon a diaphragm supported from the end of the tube by a cylindrical bellows. In this arrangement the length of the tube will vary more than that of the INVAR rod and the differences are accommodated by the bellows.

Such an arrangement has been satisfactory for some applications, typically analogue, but is not satisfactory for more stringent applications, such as digital radio where stability is critical because a slight phase variation can cause a complete loss of information. In particular, problems arise because the bellows is relatively floppy, so the contact between it and the end of the INVAR tube may vary due to temperature changes or vibration. Also, soldered joints are required between the bellows and the tube, and metal-to-metal contact between the tube and the cavity is by way of their respective screwthreads. These may cause variations in the path taken by the R.F. energy with consequent deleterious effects upon stability.

The present invention seeks to overcome these problems and to this end provides a microwave device comprising a housing having a cavity therein. A hole extends through one wall of the cavity and a tubular member having a low thermal expansion coefficient, for example INVAR (Trade Mark) extends from the hole into the cavity. The end of the tubular member in the hole is positively located, preferably by pressure contact, against axial movement relative thereto. A tuner element of dielectric material, for example a slug of quartz or sapphire, protrudes from the other end of the tubular element. The tuner element is adjustable axially relative to the tubular member to effect tuning of the device.

In preferred embodiments the tubular member has an external lip within the hole. The hole has a reduced diameter portion providing a shoulder. The lip bears against the shoulder to positively locate the tubular member axially relative to cavity. The lip may then be urged against the shoulder by a spring washer acting between the lip and a bush or holder screwed into the outer end of the hole.

Preferably the tuner element engages the interior of the tubular member at a position spaced from its end. For example, the tuner element may be a slug of lesser diameter than the interior of the tubular member, mounted on a metal boss which is arranged to cooperate with the interior of the tubular element. Conveniently the metal boss is externally screwthreaded and the tubular member correspondingly internally screwthreaded. Rotation of the boss to adjust the position of the slug of dielectric material may then be by means of a tool inserted through the tubular member and, where applicable, external bush or holder. The movement of the boss preferably is limited so that it is always shielded by the tubular member from R.F. energy in the cavity.

BRIEF DESCRIPTION OF THE DRAWING

The accompanying drawing is a cross-sectional view of a microwave cavity resonator which is one embodiment of the invention. This embodiment will now be described by way of example only.

The microwave cavity resonator shown in the drawing comprises an aluminum block 10 containing a cavity 12 of parallelepiped form with radiused corners when viewed as shown. A hole 14 extends through one wall of the cavity 12 from the outside of the block 10. The interior of the hole 14 is counterbored from the outer end to form a reduced diameter portion 16 adjacent the cavity 12. A tubular member 18 projects from the hole 14 more than halfway across the cavity 12. The tubular member 18 is made of a material having a low thermal coefficient of expansion such as INVAR (Trade Mark) which has a coefficient of about 0.6 ppm/°C.

The exterior of the tubular member 18 is stepped to provide a lip 20 adjacent its end in the hole 14. The lip 20 bears against the radially extending shoulder 22 between the reduced diameter portion 16 and the greater diameter portion of the hole 14. A conical spring washer 24 acts between the end of the tubular member 18 and the opposed end of a bush 26, which is located in the outer part of the hole 14. The bush 26 is externally screwthreaded as at 28 to engage a correspondingly screwthreaded portion 30 of the hole 14. When the bush 26 is screwed into the hole 14 it urges the lip 20 into firm abutment with the shoulder 22 to locate the tubular member 18 positively and accurately relative to the cavity 12. The member 18 is coated with copper and gold, at least its exterior between the lip 20 and the end in the cavity, and its interior adjacent that end.

The lesser diameter part of the tubular member 18 has a diameter somewhat less than that of the reduced diameter part 16 of the hole 14, resulting in a clearance therebetween so that the only contact between the tubular member 18 and the housing or block 10 is at the lip 20/shoulder 22 interface. This ensures a repeatable and predictable path for the R.F. energy.

A tuner element 32 is located in the projecting part of the tubular member 18. The tuner element 32 comprises a short cylindrical slug or rod 34 of quartz, sapphire or other suitable dielectric material mounted at one end upon a screwthreaded metal support member 36 in the form of a metal boss. The support member 36 comprises two screwthreaded parts 38, 40 interconnected by an intermediate radially-slotted part 42. The parts 38, 40 cooperate with the interior of the tubular member 18, which is correspondingly screwthreaded. The slotted part 42 is axially compressed to offset the pitches of the screwthreads on parts 38 and 40. Consequently the support member 36 is self-locking when in the tube 18. The end of the member 36 directed towards the hole 14 is slotted so that it can be rotated by a screwdriver inserted through the bush 26. The configuration of the member 36 is such that it serves as a spring-loaded, self-locking, constant torque drive mechanism.

The screwthreaded part of the tubular member 18 stops some distance from its internal end leaving a short section 44 of slightly lesser diameter through which the tuning slug 34 extends without touching. This arrangement ensures that the support member or metal boss 36, and hence the only contact between the tuning slug 34 and the tubular member 18, is always well within the tubular member 18 and so shielded from the R.F. field. Otherwise current could flow through the screwthreaded connection between the metal boss 36 and the tube and lead to an unreliable contact which would change with time, temperature, humidity or vibration.

In operation, tuning adjustments are made by screwing the support member 36, and with it the tuning slug 34, along the tubular member 18. Tuning is then maintained, despite temperature variations, by virtue of the difference between the temperature coefficients of the cavity and the tubular member 18. Thus, as the temperature increases, the size of the cavity increases which increases the inductance of the path taken by R.F. energy. However, the length of the tubular member 18 remains virtually constant so the distance between its end and the opposite wall of the cavity increases. This decreases the capacitance which tends to negate the effect on the frequency of the increase in inductance.

An advantage of embodiments of the invention is that the tubular member can be readily replaced if its internal thread becomes worn or if it is desired to change the frequency to which the cavity can be tuned.

What is claimed is:

1. A microwave device comprising a housing containing a cavity with a hole through one wall thereof, a tubular member of a material having a thermal coefficient of expansion that is low in comparison to the thermal coefficient of the housing, said tubular member being supported by one end portion positively located in the hole with its other end portion projecting into the cavity, and a dielectric tuner element located in said other end portion so as to protrude therefrom into the cavity, the tuner element being movable relative to the tubular member to vary the extent of protrusion, wherein the tuner element comprises a slug of dielectric material protruding partly from the tubular member and supported at one end in the tubular member by a metallic support member cooperating with the interior of the tubular member, means being provided for preventing the movement of the support member beyond a predetermined distance from the inner end of the tubular member such that the support member is R.F. shielded by the tubular member.

2. A device as defined in claim 1, wherein a clearance is provided between said slug and the surrounding interior surface of said tubular member.

3. A microwave device comprising a housing containing a cavity with a hole through one wall thereof, a tubular member of a material having a thermal coefficient of expansion that is low in comparison to the thermal coefficient of expansion of the housing, said tubular member being supported by one end portion positively located in the hole with its other end portion projecting into the cavity, and a dielectric tuner element located in said other end portion so as to protrude therefrom into the cavity, the tuner element being movable relative to the tubular member to vary the extent of protrusion, wherein the hole is stepped internally to form a reduced diameter part adjacent the cavity and a shoulder between the reduced diameter part and the larger diameter outer part, the one end portion of the tubular member having an external lip abutting said shoulder to positively locate the tubular member axially relative to the cavity, and means for urging the lip into contact with the shoulder.

4. A device as defined in claim 3, wherein the urging means comprises a spring washer acting between the outer end of the tubular member and the opposed end of a bush screwed into the hole.

5. A device as defined in claim 3, wherein the reduced diameter part of the hole is greater in diameter than the external diameter of the tubular member extending therethrough so as to provide clearance therebetween.

* * * * *